US005560323A

United States Patent [19]

Billings

[11] Patent Number: 5,560,323

[45] Date of Patent: Oct. 1, 1996

[54] ONE DIRECTIONAL ROTATIONAL LANCE INDEXER

[75] Inventor: Royce A. Billings, Girard, Pa.

[73] Assignee: Copes-Vulcan, Inc., Lake City, Pa.

[21] Appl. No.: 349,970

[22] Filed: Dec. 6, 1994

[51] Int. Cl.[6] ..... F22B 37/18

[52] U.S. Cl. ..... 122/379; 122/390; 122/391; 122/392; 165/95

[58] Field of Search ..... 122/379, 390, 122/391, 392; 165/95

[56] References Cited

U.S. PATENT DOCUMENTS

| | | | |
|---|---|---|---|
| 4,803,959 | 2/1989 | Sherrick et al. | 122/392 |
| 5,320,073 | 6/1994 | Silcott et al. | 122/379 |

*Primary Examiner*—Henry A. Bennett
*Assistant Examiner*—Siddharth Ohri
*Attorney, Agent, or Firm*—Pearne, Gordon, McCoy & Granger

[57] ABSTRACT

A boiler cleaning device includes a frame mounting a carriage for moving a lance in and out of a boiler along said frame. The carriage is moved by a drive-chain which passes through a differentially geared set of sprockets, one of which carries a pinion rotating a ring gear mounted on a spindle portion of the lance. The spindle has a plurality of recesses each including an abutment and a ramp while the gear carries a spring loaded plunger which engages the abutment to rotate the spindle and the lance in one direction. When the drive is reversed to move the carriage backward, the gear rotates the other direction and the plunger merely rides up the ramps and down the abutments and the spindle does not rotate.

12 Claims, 3 Drawing Sheets

27
28
26
22
48'
47'
2
2
45
46
3
3
47
32
48
35
12
10
31
21
24

74
73
82
85
84

58
81
79
76
78
54

16
17
13
64
66
15
14

ONE DIRECTIONAL ROTATIONAL LANCE INDEXER

BACKGROUND OF THE INVENTION

This invention relates generally to boiler cleaning machines and more particularly to cleaning machines such as water deslaggers and soot blowers having a rotary lance which reciprocates out from and back into a housing outside the boiler.

The operation of boilers for steam power plants, particularly using coal of lower grade, results in the gradual build-up of various materials on the interior surfaces of the boiler exposed to flame. In some cases, the coating that builds-up is merely soot particles which adhere strongly to the surfaces, but the use of certain types of coal results in the build-up of a slag material on the hotter surfaces. In order to maintain peak boiler efficiency, it is necessary to periodically keep cleaning off these deposits to eliminate their insulating effect to insure maximum heat conduction between the flame and the boiler surfaces generating steam. While some materials such as soot can be removed with a blast of compressed air or steam, slag generally requires a water spray which will cool the hot slag, and by causing it to crack from temperature differentials will allow it to flake away and drop to the bottom of the boiler where it can be removed.

This type of cleaning is generally accomplished by means of a moving lance having a nozzle at the front end thereof which is moved into and out of the boiler chamber while rotating to spray the steam or water directly on the surfaces to be cleaned. Generally, the cycle of extension and retraction does not take more than several minutes to avoid excessive exposure of the lance to the heat within the boiler chamber, while the mechanism for moving the lance is supplying it with cleaning fluid remains outside the boiler.

There are many mechanisms that have been proposed for moving the lance in and out of the boiler and the selection of these mechanisms may depend upon the frequency in which the cleaning lance is cycled as well as the length the lance projects into the boiler or its total length of travel. While generally cables are used to traverse a carriage on relatively long lances, other mechanisms such as chains and racks may be used to traverse the carriage carrying the lance in and out of the boiler. The mechanism that provides power for moving the carriage also rotates the lance so that it is effectively rotationally driven by a gear arrangement driven by the carriage reciprocating mechanism. One of the problems with this arrangement is that because of the geared relationship and the fact there is generally one or two spray nozzles on the tip of the lance, these nozzles tend to travel over the same path on each cleaning cycle and this tends to limit the area being cleaned in direct alignment with the nozzle. Because of the rate at which the cleaning fluid is sprayed, the rotational speed of the lance is limited to insure complete coverage of the area under the nozzle, and to cover the entire areas in the helical path that results generally requires an excessive rotational number of turns per unit of lance movement. This would tend to mean a very tight helix which might require excessive time of exposure within the boiler.

One alternative to this is to provide a lost motion connection in the drive between the advance and retract so that by taking up the lost motion the retraction helix is shifted from the advancing helix to provide more complete coverage of the area being cleaned. However, this still leaves only two different patterns for the spray, and this may still leave much of the area untouched by the cleaning fluid.

SUMMARY OF THE INVENTION

The present invention provides a new and improved boiler cleaning machine in which the traveling lance is indexable to provide a multiple number of spray paths to provide more complete coverage of the surfaces to be cleaned. The lance is provided with a unidirectional rotational drive so that, for example, it is rotationally driven during the extend cycle during which spraying occurs, after which the lance is retracted without rotation back to the start or fully retracted position. The driving engagement is accomplished by means of a unidirectional drive which may take the form of ramps formed on hub attached to the lance while a rotating member carries a spring loaded plunger which moves down the ramps into an abutment to drivingly engage the hub for rotation in the one direction. On retraction, the gear rotates the other direction and the detent plunger simply rides down the abutments and up the ramps without providing any rotational drive to the hub.

According to the preferred embodiment of this invention, the boiler cleaner is a wall deslagger which extends outward through a boiler wall and sprays water backwards towards the wall at an angle so that as it is rotated and extended, the spray pattern forms a spiral on the boiler wall surface. By spraying outward, the spiral is started at the center adjacent the opening through which the lance extends and increases in size until the lance reaches the full length of travel, after which the spraying is fluid, such as water, is shut off and the lance retracted without rotation.

According to this embodiment of a deslagger, the mechanism includes an elongated housing outside the boiler providing rails along which a carriage slides. The carriage has a driving mechanism for rotating the lance and in turn is driven by an endless chain powered by a reversible motor. Both reaches of the chain pass through sprockets rotatably mounted on the carriage and these sprockets are geared together inside the carriage by gears having different numbers of teeth. Thus is the chain is driven in one direction, the differential results more chain building up near the drive motor so that the carriage is moved along the rails to the other end of the housing which is the full extended position for the lance. When the motor is reversed, the effect of the chain drive is the opposite and moves the carriage back into the other end of the housing adjacent the drive motor.

The lance carries a hub around which is fitted a drive gear carrying a bevel gear driven by a pinion from one of the chain sprockets shafts. The drive gear is normally freely rotatable in either direction on the hub which carries the lance and a portion of the hub has a plurality of detent receiving surfaces comprising a sloping ramp which in one direction slopes toward the central axis of rotation until it terminates in a radially extending abutment. The drive gear carries a radially movable spring loaded plunger in alignment with the plurality of recesses.

According to the preferred embodiment there is an odd number, such as seven, of the recesses spaced equidistantly around the periphery of the hub lying in a plane normal to the axis. The drive mechanism is arranged to rotate the drive gear through a number or rotations plus an additional half rotation to insure that starting from a position where the plunger is in engagement with an abutment surface the drive gear, hub and lance are rotated through a number of revolutions to stop in a position with the plunger position 180° away from the start position so that the hub is rotated the same number of revolutions minus half of the angular spacing between adjacent recesses. When the lance is retracted, the drive gear is rotated in the opposite direction to allow the plunger to drop into the recesses and ride up the ramp to the outer surface of the hub and the ramps are arranged at such a shallow angle there is substantially no driving force is imparted to the hub. At the end of the retract cycle the drive gear is positioned with the detent plunger in the original position as it was at the start of the cycle, but the hub has now been rotated a distance with the differential equal to one half of the angular spacing between the adjacent recesses. When the next cycle is started, the plunger then rotates in the same direction and rides down a ramp and engages an abutment surface after rotating through an angle equal to one-half of the angular spacing between adjacent recesses. Thus, the lance is angularly and hence axially displaced with respect to its previous cycle by the full angular spacing between recesses.

In the case above described with seven recesses, this means that seven different paths are followed by the lance before original pattern is repeated and such paths are uniformly spaced by the same incremental amount.

It is recognized that the above example is by way of example only and this mechanism is applicable to other devices such as soot blowers which may blow steam or air and is practical independent of the length of extension of the lance.

The foregoing and other features and advantages of the invention will become more apparent upon a study of the following detailed description of the preferred embodiment of the invention as shown in the accompanying drawings.

DETAILED DESCRIPTION OF THE PREFERRED EMBODIMENT

Figures 1, 2, 5, 6:
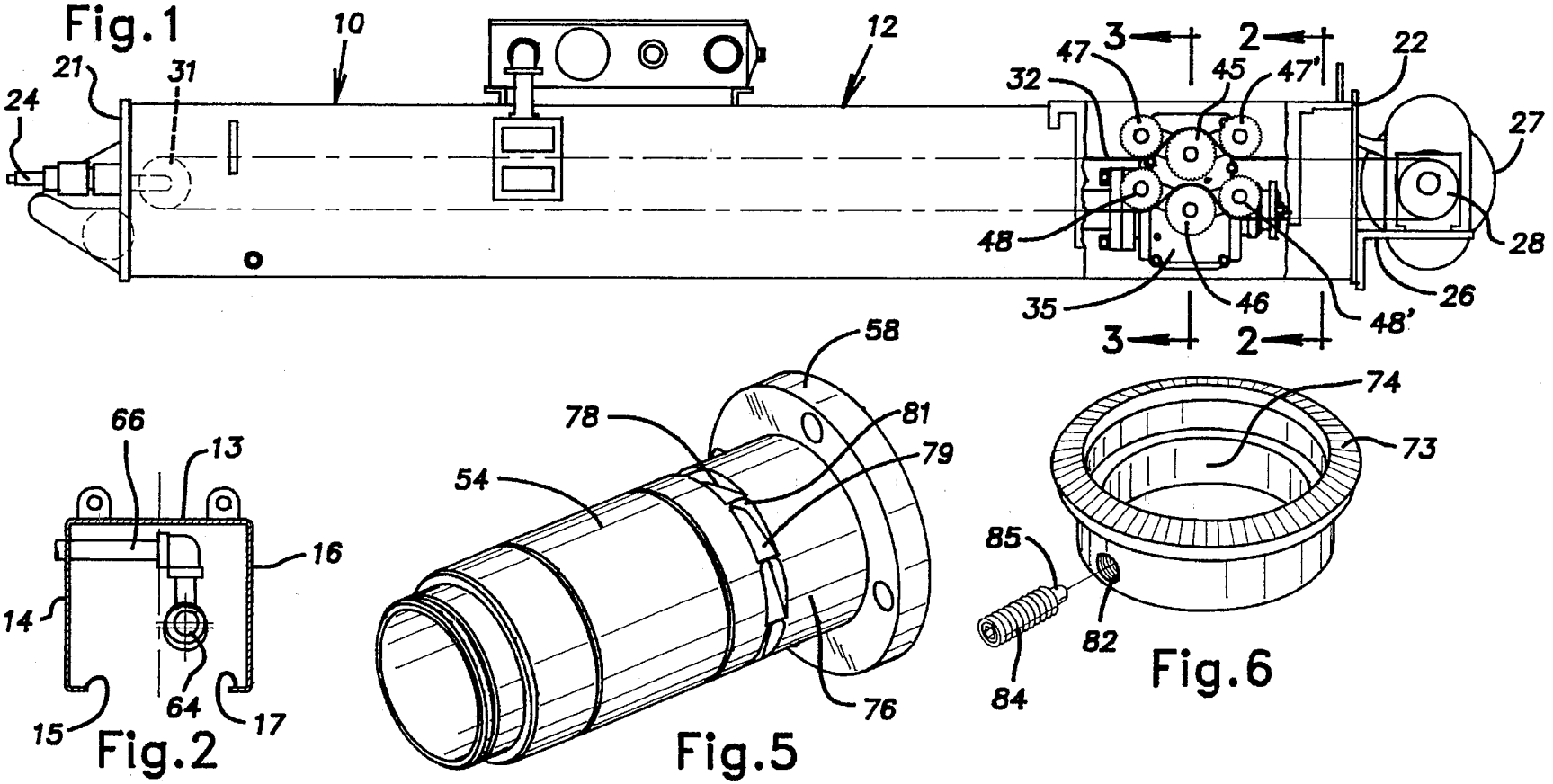
FIG. 1 is an elevational view with parts broken away of a rotary wall deslagger according to the preferred embodiment of this invention.
FIG. 2 is a cross-sectional view taken on line 2—2 showing the water connection to the lance.
FIG. 5 is an enlarged perspective view of the hub which supports the lance and receives the supply tube.
FIG. 6 is a perspective view of the drive gear shown in FIG. 4.

Referring to the drawings in greater detail, the water deslagger 10 according to the preferred embodiment of this invention includes an elongated housing 12 generally in the form of an inverted channel having a top wall 13 and side walls 14 and 16 extending downward therefrom. Lips 15 and 17 extend inwardly at the bottom of the walls 14 and 16 and provide rails for the carriage as described hereinafter.

Since the housing 12 is hollow except for the walls 13, 14 and 16, it must be closed off at the ends and accordingly it has a front wall 21 adjacent the boiler (not shown). At the other end is a vertical back wall 22. The front wall 21 is provided with an opening (not shown) through which the lance tip 24 projects and is extended during a cleaning cycle. The lance tip 24 carries a nozzle(not shown) which sprays the cleaning fluid on the interior of the boiler. The backwall 22 carries on its outer side a bracket 26 on which is mounted an electric motor 27 adapted to drive a chain sprocket 28. Another chain sprocket 31 is mounted on the inside of the front wall 21 and a drive chain 32 extends in endless form over the sprockets 28 and 31 and is driven by the reversible electric motor 27.

The lance is supported and driven through a carriage 35 mounted within the housing 12 and having left and right cases 36 and 37 connected together by suitable means such as bolts (not shown). To support the carriage 35, left and right skid members 41 and 42 are mounted on the bottom of the carriage and slide along the lips 15 and 17 on the housing. A pair of parallel upper and lower shafts 43 and 44 are rotatably journalled in the left case 36 by suitable bearings and are positioned one above the other. The outer ends of the shafts 43 and 44 carry upper and lower sprockets 45 and 46 drivingly connected to the shafts. A pair of upper idler sprockets 47 and 47' are rotatably carried on the left case 36 on each side of the upper shaft and positioned above the center line of the shaft. Likewise a pair of lower idlers 48 and 48' are rotatably carried on suitable stub shafts on a left case 36 on either side of the lower sprocket 46. The purpose of the idlers 47, 47' 48 and 48' is to ensure a sufficient wrap of the drive chain 32 around the respective sprockets 45 and 46 for good driving connection.

At their inner ends within the carriage 35, the upper and lower shafts 43 and 44 are geared together by mating gears 51 and 52. While these gears are always in mesh, they do have different numbers of teeth with the upper gear 51 having preferably fewer teeth in the lower gear 52. This ensures positive motion of the carriage 35 along the housing 12 as a result of this differential gearing. If the motor 27 is rotated in a clockwise direction as shown in FIG. 1, the top side of the drive chain 32 will move toward the motor 27 and backwall 22 and since the drive chain passes over the upper side of upper sprocket 45, it will be rotated in a clockwise direction and hence the lower sprocket 46 will be rotated in a counter-clockwise direction. Since the upper sprocket 45 rotates at a greater rotational speed, the drive chain will tend to accumulate to the rear of the carriage and hence the carriage will be forcibly moved by the chain toward the front wall 21 which serves to extend the lance out into the boiler area to be cleaned. Likewise, when motor 27 is reversed to rotate in the counter-clockwise direction, the upper sprocket 46 also rotates counter-clockwise and since it rotates faster than the lower sprocket 46, the excess of chain will accumulate in the space between the carriage and the front wall 21 and the carriage will be driven by the chain 32 back to the retracted position adjacent the backwall 22.

In order to support and drive the lance, a hollow spindle 54 is rotatably journalled in the right case 37 of carriage 35 by bearings 56 and 57. The spindle 54 carries a flange 58 on the front end and this receives a mating flange 59 which is clamped to it by bolts 60. The mating flange 59 is welded to the lance 61 which extends forward from the carriage and out through the front wall 21 to the lance tip 24. It will be understood that suitable support rollers are provided near the front wall 21 to guide and support the lance in its reciprocating movement out of and back into the housing 12. In order to supply the cleaning fluid, such as water or steam, a supply tube 64 fits telescopically within the lance 61 and extends to the backwall 22 where it is connected to a supply by suitable piping 66 (see FIG. 2). In order to provide sealing, the spindle 54 receives at the rear end packing 67 which is pressed in place by a sleeve 69 in the well known manner so that the packing 67 can slide along the supply tube while providing sealing as a carriage reciprocates within the housing.

The rotational drive for the lance 61 is provided through a pinion 71 secured to and rotatable with the lower shaft 44. A ring or bevel gear 73 is provided with an axial bore 74 which is journalled directly on the outer surface 76 of spindle 54. While the ring gear 73 is positively driven by the pinion 71 in both directions, a drive coupling between the ring 73 and the spindle 54 is provided only in one direction by the mechanism described hereinafter.

Figure 3:
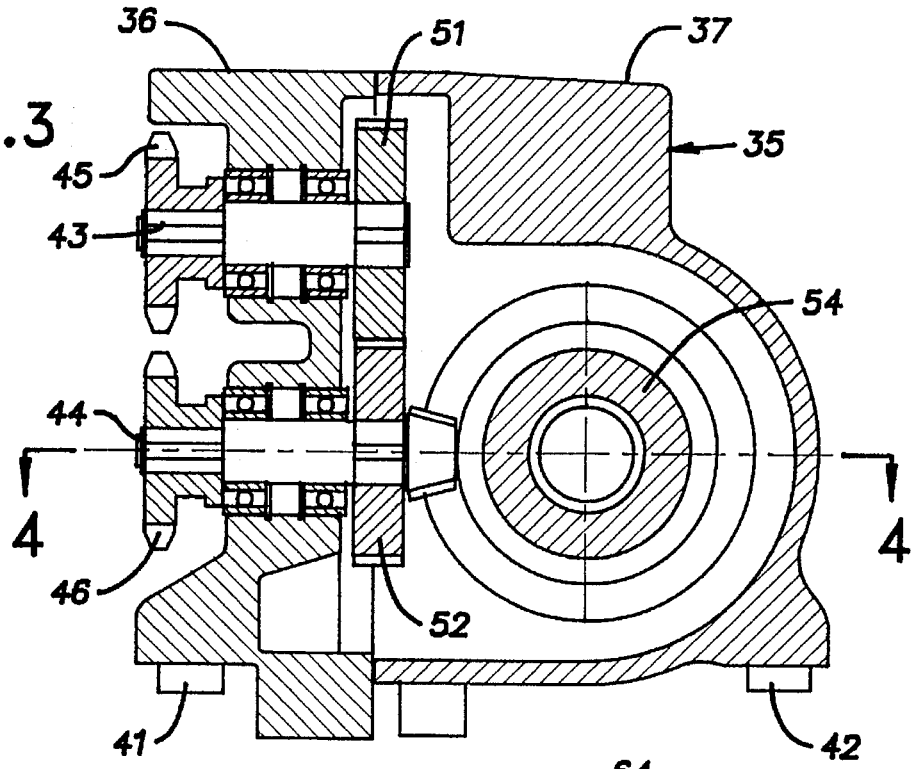
FIG. 3 is a vertical cross-sectional view through the carriage taken on line 3—3 of FIG. 1.
Figure 4:
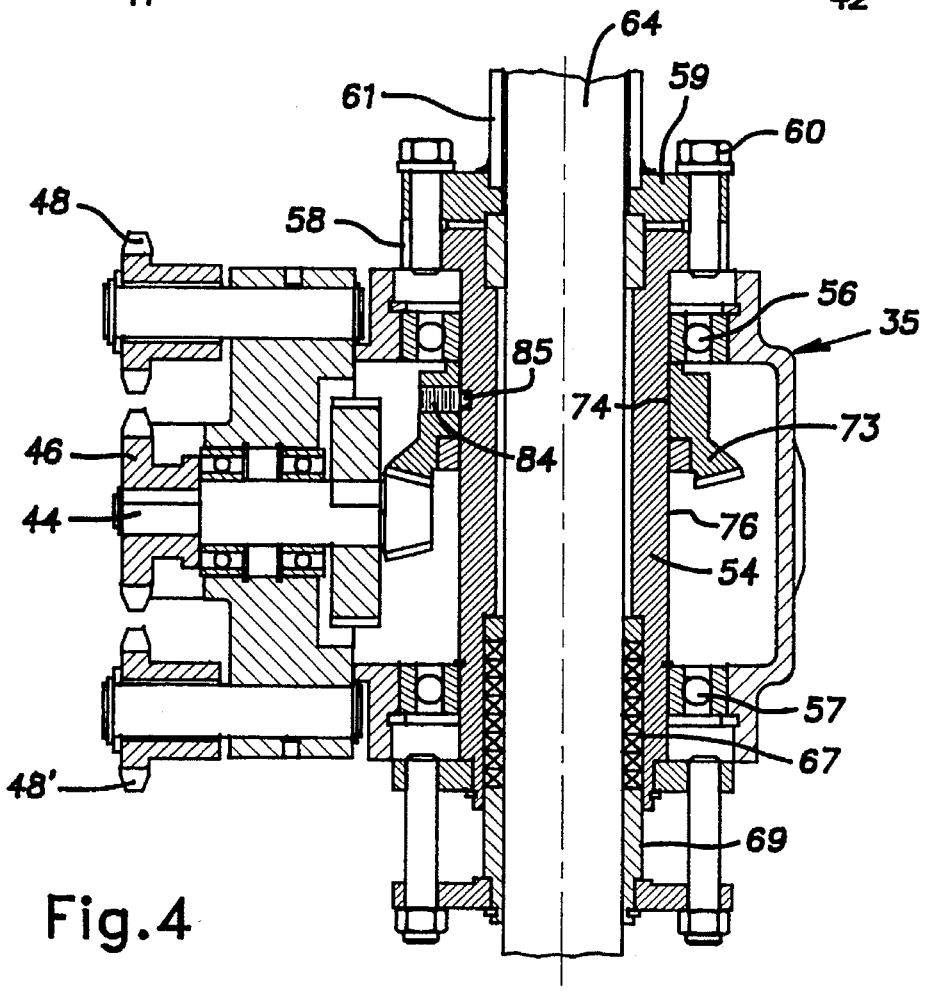
FIG. 4 is a horizontal cross-sectional view through the carriage and lance taken on line 4—4 of FIG. 3.

As most clearly shown in FIG. 5 the outer surface 76 of spindle 54 is provided with a plurality of recesses 78 spaced equidistantly around the periphery of the surface and lying in the same axially spaced position. Each of these recesses 78 includes a ramp portion 79 sloping inwardly to terminate in a radial abutment 81 which provides a surface extending perpendicular to the axis of the spindle. The ring gear 73 has a radial bore 82 extending through the wall and in this bore is mounted a detent 84 carrying a spring loaded plunger 85 (see FIG. 6) which is engageable with the recess 78. Thus, when the ring gear 73 is rotated in a counter-clockwise direction, as shown in FIG. 3, the plunger 85 will rotate so that it slides down a ramp 69 and extends until engages abutment 81. Continued rotation of the ring gear 73 in the counter-clockwise direction causes the spindle 54 to rotate with the ring gear 73. On the other hand, when the ring gear is rotated in the clockwise direction, the plunger 85 will ride up the ramp 79 over the spindle surface 76 and drop into the next recess 78. This process will be repeated as the ring gear rotates and no driving connection will be provided to the spindle 54.

Figure 7:
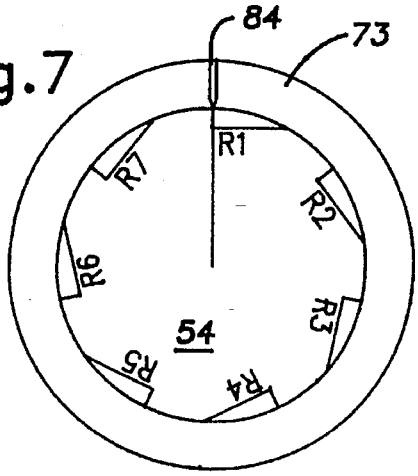
FIG. 7–13 show the sequential cycles for indexing the lance.
Figure 8:
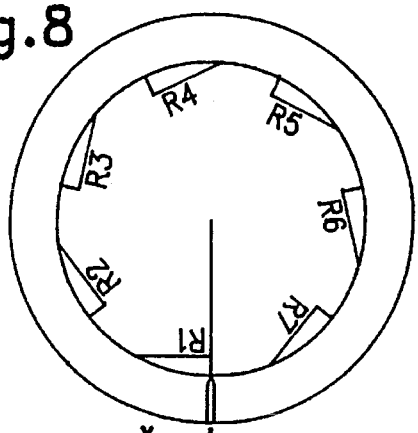
Figure 9:
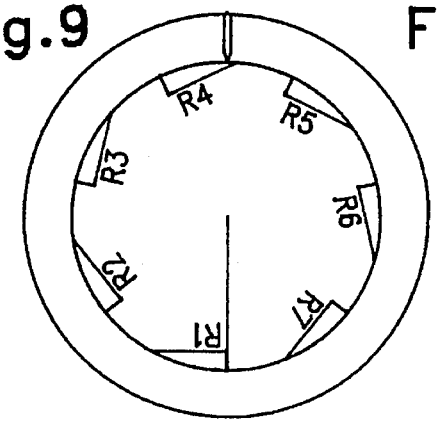

The operation of the indexing mechanism is best shown in FIGS. 7–13 showing a sequence of operations. The recesses have been numbered R1–R7 so that they are seven in number and spaced equidistantly about the spindle. As shown in FIG. 7, at the start of the operation, the detent 84 is aligned with recess R1 so that as the ring gear 73 is rotated counter-clockwise, the spindle is rotated with it. The blowing pattern for the lance is such that on a complete lengthwise travel of the carriage 35, the ring gear 73 is rotated a number of revolutions plus an additional half revolution and this can be determined by the ratio of the gears 51 and 52. Assuming that the lance makes twenty-three and one-half rotations, the ring gear and spindle in end up in the position shown FIG. 8 which will be the drive position when the carriage 35 stops at the forward end of its travel adjacent to the front wall 21. The drive motor 27 is now reversed bringing the carriage 35 back toward the rear wall 22 so that the ring gear 73 again makes twenty-three and one-half revolutions in the clockwise direction. The spindle 54 does not rotate because of the lack of driving connection between the ring gear and the spindle, and as a result at the end of this travel the ring gear is in the position shown in FIG. 9 with the detent 84 now being exactly 180° out of phase with the driving recess R1 and closely aligned on the ramp on recess R4.

Figure 10:
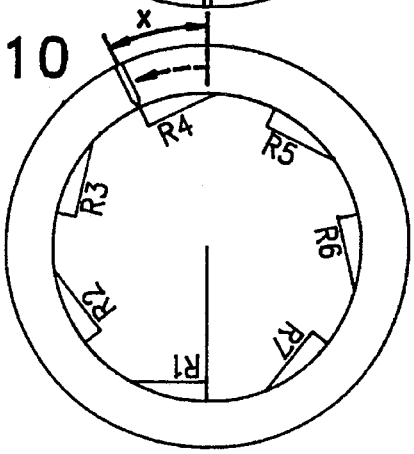
Figure 11:
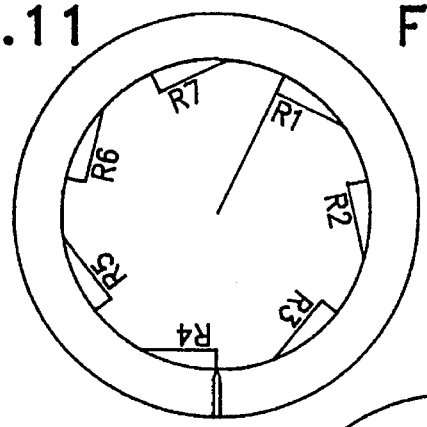
Figure 12:
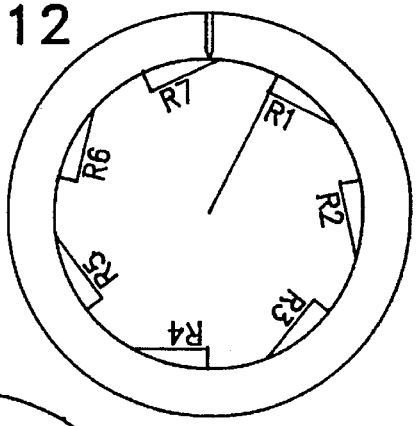
Figure 13:
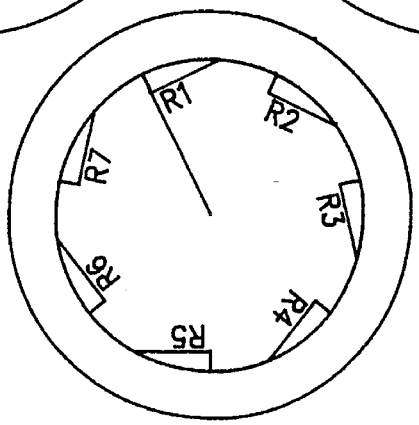

On the next cycle the ring gear must rotate through an angular distance shown in FIG. 10 as X, which equals one-half of the angular spacing between the recesses. When the detent 84 reaches the abutment on recess R4, the driving connection is again engaged, and the ring gear and the spindle rotate together. Again, at the end of the twenty-three and one-half rotations the parts are in the position shown in FIG. 11 with the recess R4 at the bottom. At the end of the next retract cycle the ring gear and spindle are in the position shown in FIG. 12 where at the start of the next cycle the ring gear will rotate through the angle X until it engages the abutment on recess R7. Thus it will be seen that each time a cycle begins the lance is in effect indexed backwards or clockwise with respect to the ring gear, with half of the indexing being a lost motion at the start of the driving cycle and half being the result of the half rotation. The engagement of the recesses continues in an alternative manner following recess R1 then R4, R7, R3, R6, R2, R5 and finally back to R1. After seven blowing cycles which with R5 being the last recess used for driving, the parts are in the position shown in FIG. 13 so that in this case the cycle will begin with R1 and again a rotation of X degrees will be required before engagement with the abutment on ramp R1.

Although the above example has used seven detents with an extra one-half revolution, other combinations of partial revolutions and detents could also be used as long as a portion of the spacing occurs from the differential partial revolution while the rest results from a lost motion at the start of the driving cycle. For example, an alternative would be to use four recesses with an extra one-third revolution. In this case, the retract cycle recovers 60° of the spacing leaving a lost motion movement of 30° before the detent hits the adjacent abutment and starts the driving relationship. Also, in the case of four detents and a one-third revolution, the detents will be advanced in order and the paths spaced accordingly.

Although the preferred embodiment of this invention has been shown and described, it is recognized that various other modifications and rearrangements may be resorted to without departing from the scope of the invention as defined in the claims.

What is claimed is:

1. A boiler cleaning device comprising a frame, a lance tube having a longitudinal axis and being reciprocally mounted in said frame for movement along said axis between an extended position and a retracted position, nozzle means on said lance tube, a first drive operable to reciprocate said lance tube through a full cycle between said extended and retracted positions, a second drive operable by said first drive for rotating said lance tube about said longitudinal axis in timed relationship to the reciprocation thereof, said drives causing said nozzle means to produce a helical spray pattern while moving said lance tube to said extended position, said drives thereafter moving said lance tube to said retracted position, and means operable between cycles to rotatably index said lance tube with respect to said second drive a predetermined portion of a revolution so that on each successive cycle said helical pattern is shifted a spaced distance along said axis.

2. A boiler cleaning device as set forth in claim 1 wherein said lance is rotated only when moving from the retracted position to the extended position and is not rotated during movement from the extended position to the retracted position.

3. A boiler cleaning device as set forth in claim 1 wherein said second drive includes a spindle member secured to said lance and a gear member rotatably mounted on said spindle.

4. A boiler cleaning device as set forth in claim 3 wherein said indexing means includes a plurality of recesses on one of said members and a recess engaging detent on the other of said members.

5. A boiler cleaning device as set forth in claim 4 wherein each of said recesses includes a ramp and an abutment and said detent is a spring loaded plunger.

6. A boiler cleaning device comprising a frame, a carriage movably mounted on said frame, lance tube having a longitudinal axis and being rotatably mounted on said carriage for rotation about said axis, said carriage being movable along said axis between an extended position and a retracted position, nozzle means on said lance tube, a first drive operable to reciprocate said carriage through a cycle between said extended and retracted positions, a second drive operable by said first drive for rotating said lance tube about said longitudinal axis in timed relationship to the reciprocation thereof, said drives causing said nozzle means to produce a helical spray pattern while moving said lance tube to said extended position, said drives thereafter moving said lance tube to said retracted position, and means operable at said retracted position to rotatably index said lance tube with respect to said second drive a predetermined portion of a revolution so that on each successive cycle said helical pattern is shifted a spaced distance along said axis.

7. A boiler cleaning device as set forth in claim 6 wherein said lance is rotated by said second drive only when moving from the retracted position to the extended position and is not rotated by second drive during movement from said extended position to said retracted position.

8. A boiler cleaning device as set forth in claim 6 wherein said second drive includes a spindle member secured to said lance and rotatably journalled in said carriage and a gear member rotatably mounted on said spindle.

9. A boiler cleaning device as set forth in claim 6 wherein said indexing means includes a plurality of equidistantly spaced recesses on one of said members and a recess engaging detent on the other of said members.

10. A boiler cleaning device as set forth in claim 9 wherein each of said recesses includes a ramp and an abutment and said detent is a spring loaded plunger.

11. A boiler cleaning device as set forth in claim 10 wherein said recesses are on said spindle and said detent is on said gear.

12. A boiler cleaning device as set forth in claim 6 wherein said drive rotates said lance a whole number of revolutions plus a fraction of a revolution to provide a portion of the indexing movement of said drive.

* * * * *